United States Patent [19]

Schnall et al.

[11] 4,141,545

[45] Feb. 27, 1979

[54] PAPER FEED FOR COPYING MACHINE

[75] Inventors: Gunther Schnall, Eching; Klaus Aldenhoven, Unterpfaffenhofen; Hanns Blochl, Unterhaching, all of Fed. Rep. of Germany

[73] Assignee: AGFA-Gevaert AG, Leverkusen, Fed. Rep. of Germany

[21] Appl. No.: 846,506

[22] Filed: Oct. 27, 1977

[30] Foreign Application Priority Data

Oct. 29, 1976 [DE] Fed. Rep. of Germany ..... 2649673

[51] Int. Cl.[2] ..... B65H 3/06

[52] U.S. Cl. ..... 271/118

[58] Field of Search ..... 271/10, 95, 102, 109, 271/118

[56] References Cited

U.S. PATENT DOCUMENTS

| | | | |
|---|---|---|---|
| 2,585,873 | 2/1952 | Stephenson | 271/118 X |
| 3,888,479 | 6/1975 | Eder | 271/118 X |

*Primary Examiner*—Richard A. Schacher
*Attorney, Agent, or Firm*—Michael J. Striker

[57] ABSTRACT

A copying machine has a scanner movable in a forward direction to scan a master sheet and in a reverse direction to return to its starting position. A drive shaft of the machine rotates similarly forwardly and backwardly to displace this scanner and is connected to a pair of cams, one of which controls a pickup arm for sliding the uppermost sheet off a paper supply stack and the other of which is connected to a pair of pinch rollers which advance the picked up sheet through the imaging mechanism of the machine. Each of these cams has an operating portion which actuates the respective machine element during forward rotation of the cams, but which is brought out of engagement with the respective cam follower during reverse operation of the machine so that during return of the scanner to the starting position the pickup arm and pinch rollers are not operated.

14 Claims, 8 Drawing Figures

PAPER FEED FOR COPYING MACHINE

BACKGROUND OF THE INVENTION

The present invention relates to a copying apparatus. More particularly this invention concerns a drive arrangement for the paper feed in a copying machine.

A copying apparatus is known such as shown in German published specification No. 2,226,358, whose entire disclosure is herewith incorporated by reference, which feeds paper from a stack at a paper supply past imaging equipment that forms a toner image on the paper and thence past a fuser to an output tray. The imaging equipment can comprise a selenium-coated drum and the fusing equipment can use either a radiant heater or a pressure rollers. Other copying methods may also be used.

Typically the paper is held in a stack underneath a pivotal pickup arm having a roller at one end which is continuously rotated. The pickup arm can be dropped down onto the uppermost sheet in the stack so as frictionally to engage it and slide it off the stack. Each time the pickup arm is briefly dropped down into contact with the uppermost sheet of the stack it therefore slides a sheet off the stack.

Downstream of the pickup arm there is typically provided a pair of pinch rollers which define a closed paper-receiving nip to which the leading edge of the copy sheet is fed. These rollers are rotated stepwise, that is they are periodically rotated to advance the sheet through the machine along the paper-feed path in accordance with the cyclical programmed operation of the machine. The main function of these pinch rollers is to properly align the leading edge of the sheet along the paper path at a perfect right angle to the direction of travel so that when these pinch rollers are rotated the leading edge will not only be properly aligned perpendicular to the paper feed direction, but will also be at the exact desired position for proper registration of the image on the copy sheet.

The master being copied is normally held on a copy window, usually above the above-described mechanism. A scanning device including mirrors and at least one lamp is reciprocal back and forth underneath this window to scan the copy a line at a time. Normally a drive arrangement including a heavy-duty main drive shaft is connected to this scanner so that when rotated in one direction it displaces the scanner across the master and when rotated in the opposite direction it returns the scanner to its starting position. Since this is the heaviest element of the copier the displacement of the other parts of the machine is typically made dependent on the displacement of the scanner.

Thus it is standard practice to provide solenoids and the like operated by cams or the like carried by the scanner drive shaft for synchronously operating the pickup roller and pinch rollers with the scanner. Once during each copy cycle the pickup roller must be dropped down into contact with the uppermost sheet in the stack so as to slide it into the nip of the pinch rollers, and thereafter once during each cycle the pinch rollers must rotate to feed the thus aligned sheet along the conveyor path. Such arrangements are typically rather expensive and failure-prone. If the operation of the pickup arm and pinch rollers is off by the slightest amount of time the copy image will be misaligned on the copy sheet and the copy might be unusable.

SUMMARY OF THE INVENTION

It is an object of the present invention to provide an improved copying apparatus.

Another object is the provision of an improved drive arrangement for a copying apparatus which is simpler and less failure-prone than the above-described arrangement.

These objects are attained according to the present invention by a mechanical drive arrangement for the pickup arm and pinch rollers. Respective pickup and pinch cams are mechanically permanently connected to the drive shaft for the scanner so as always to rotate therewith. Means in the form of a deflector is provided, however, for operation of the pickup arm and pinch rollers only at the appropriate time during the forward displacement of the scanner during the paper cycle, but for displacing the cam portions out of engagement with the respective cam followers during reverse rotation.

It is therefore possible in an extremely simple mechanical manner to operate the pickup roller and pinch rollers in accordance with the main drive of the scanner. Once the respective starting positions are determined the mechanical nature of the transmission ensures that the synchronous operation will be perfectly maintained at all times. The possibilities of failure due to complex electrical components, and the concomitant cost of such components, is therefore avoided.

It has been suggested to control the pickup arm and pinch rollers by means of cams carried on a shaft which rotates one full revolution for each copying cycle. The considerable disadvantage of this arrangement is that it is therefore necessary to set the machine for the maximum copy length. When a smaller copy is made the arrangement must nonetheless turn through its entire revolution. With the system according to the instant invention, however, the machine can be set for a relatively short copy and will still function perfectly, with the shaft or shafts carrying the cams reversing at the end of the copy length set. Thus even the purely mechanical system according to the instant invention can be set for copies of different lengths in accordance with best copying practice and most efficient use of toner. Even when making very short copies the synchronization between the paper-feed elements and the scanner remains perfect.

According to further features of this invention the pinch and pickup cams are both mounted on a common cam shaft which is directly connected to the drive shaft for the scanner for joint rotation therewith in both of its transport directions. Thus the relatively heavy-duty drive for the scanner is used to actuate the pickup arm and pinch rollers. The pickup arm carries a roller which is continuously rotated, and the pinch rollers can be connected via a closable clutch operated by the pinch cam follower to a continuously rotating drive shaft. Thus the drive for the scanner serves merely to drop the arm down onto the top of the paper stack so that the continuously rotating pickup roll slides a sheet therefrom, and also serves to close the clutch between the pinch rollers and a continuously rotating drive shaft.

In accordance with another feature of this invention the pinch cam is constituted as a pair of flexible disks of identical shape carried on the cam shaft. These two disks have a lobe or cam portion whose trailing end relative to the forward direction of rotation thereof has bent apart edges. When rotating forwardly this cam portion engages directly radially against the follower of the pickup arm, but when rotating in the reverse direction the deflector, which is a wedge or point on the pickup follower, engages between the bent-apart ends or corners of the pickup cam portion and spreads the two disks so that they move adjacent the pickup cam follower and do not press it down against the paper stack. Such an arrangement can, of course, have only one such flexible disk which is deflected axially to the side during reverse rotation so as not to actuate the pickup arm.

The pinch cam can be a dish-type cam having a rim on the inner edge of which rides the cam follower of the pickup rollers. The inner edge of the cylindrical rim itself forms an outer track and an inner track extends parallel to it over a portion of its periphery, with the deflector extending from the inner track to the outer track. This deflector is pivotal inwardly toward the radius of the pinch cam when engaged from behind during reverse rotation of the pinch cam. The pinch follower can fit between the inner track and the outer track. When rotating forwardly the pinch follower rides up on the deflector to the inner track and connects the pinch rollers via an actuating arm and a clutch to a continuously rotating shaft, the pinch follower shortly thereafter dropping off the rear end of the inner track onto the outer track. On subsequent rotation of the pinch cam in the reverse direction the pinch cam follower travels backward under the inner track on the outer track and displaces the deflector inwardly against its resilient spring force so as to remain on the outer track, but to prepare its way back to ride up on the inner track on renewed forward rotation of this pinch cam.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawings.

SPECIFIC DESCRIPTION OF A PREFERRED EMBODIMENT

Figure 1:
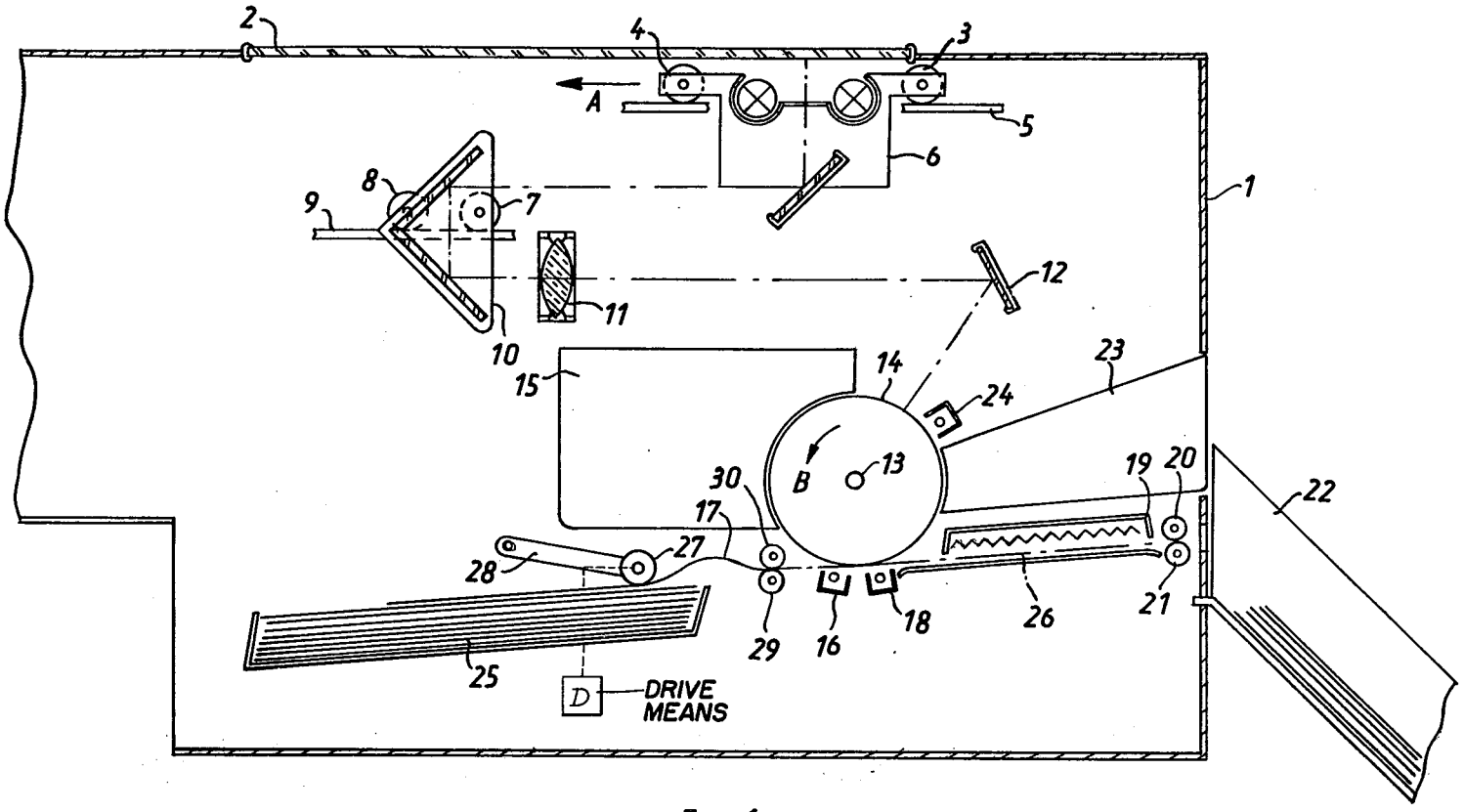
FIG. 1 is a vertical section through a copying apparatus according to the instant invention.

A xerographic or electrostatic copying apparatus according to this invention has a housing 1 on whose upper wall is provided a transparent copy window 2 under which a scanning assembly 6 may move via wheels 3 and 4 on a horizontal rail 5 in a scanning direction A. The line-by-line image picked up by the scanning assembly 6 which has appropriate lamps and mirrors is reflected off a mirror assembly 10 riding via rollers 7 and 8 on a horizontal track 9 and passes through a focusing bar lens 11 and a fixed mirror 12 to a drum 14 rotatable during copying about an axis 13 in a forward direction B. Mirror assembly 10 is moved parallel to to the scanner assembly 6 at half the speed thereof so that the distance of travel of the picked up image remains the same.

Imaging equipment 15 applies toner to the drum which, as is well known, adheres to those regions which have picked up a charge by being irradiated. The image is then supplied to a copy sheet 17 which passes between the drum 13 and a transfer coratron 16 and discharge coratron 18. Thereafter the copy sheet passes under a fuser station 19 and between output rolls 20 and 21 to an output paper tray 22. Cleaning equipment 23 serves to remove any toner from the drum 14 and a recharging coratron 24 is provided in the manner well known in the art, which need not be gone into a further detail here.

A supply of the sheets 17 is held in a stack 25 inside the housing 1 of the machine beneath pickup arms 28 (also called pickup cam followers) pivotal about a fixed axis **28*a* in the machine and carrying continuously rotating pickup rollers 27 (driven by known per se and diagrammatically shown drive means) as the arms 28 drop the continuously rotating rollers 27 down onto the uppermost sheet 17 of the stack 25, then slide it off the top of the stack to the nip defined between a pair of pinch rollers 29 and 30. These rollers 29 and 30 rotate about respective fixed axes in the housing 1 and are only driven to advance the paper past the drum 14 when a copy is to be made. The main function of these rollers 29 and 30 is to insure that the leading edge of the sheet 17 is aligned exactly perpendicular to the direction of travel along the path 26 followed by the sheets 17** through the machine.

Figure 2:
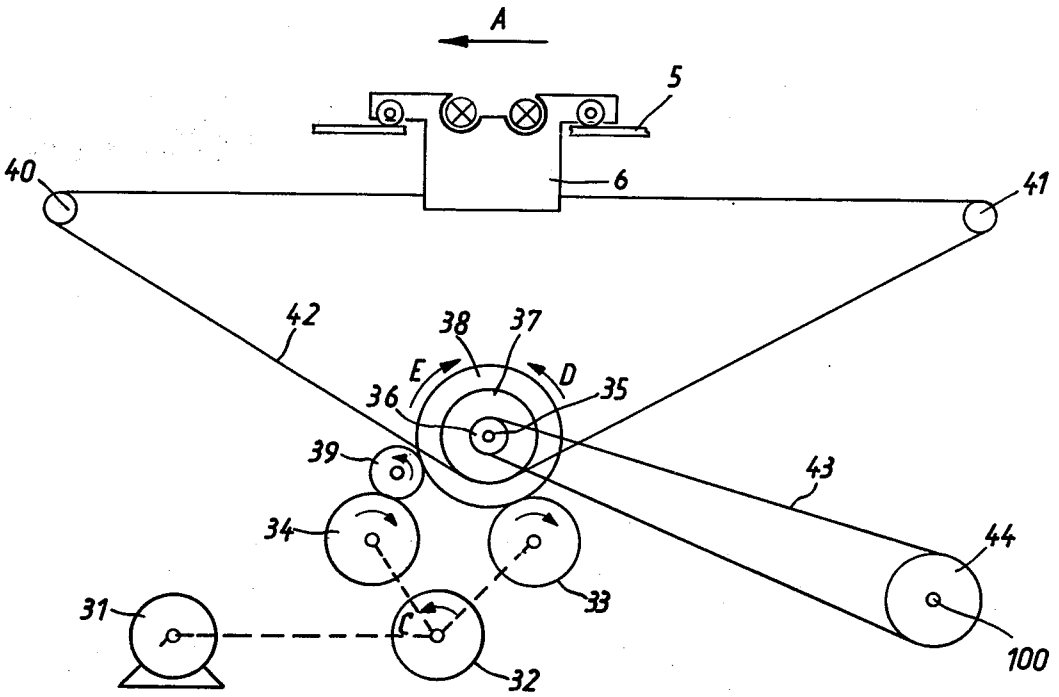
FIG. 2 is a large schematic view of the scanner drive for the apparatus of FIG. 1.

FIG. 2 shows how a continuously operating drive motor 31 has an output shaft connected to a drive gear 32 so as to rotate this drive gear 32 in the direction indicated by arrow C. Similarly, this drive motor 31 serves to operate the drum 14 of FIG. 1 so that it rotates in the direction indicated by arrow B. The output gear or drive element 32 can be connected via either of a pair of clutches indicated schematically at dashed lines 32' and 32'' to either of two respective gears 33 and 34. The former meshes directly with the gear 38 and the latter meshes via an intermediate gear 39 with the gear 38. Thus when the drive element 32 operates the gear 38 via the gear 33 it will displace it in counterclockwise direction D and when it operates it through gear 34 the rotation direction will be that indicated by arrow E. A pulley or sprocket 37 carried on the gear 38 is reeved with a chain 42 spanned over idler sprockets 40 and 41 and connected to the carriage 6 of the scanning device for displacement of this scanning device horizontally in either direction under the window 2.

In addition the shaft 35 of the gear 38 and sprocket 37 also carries a sprocket 36 fixed to the sprocket 37 and gear 38. A chain or toothed belt 43 spanned over this element 36 is also spanned over a toothed wheel or sprocket 44 fixed on a cam shaft 100. Thus this shaft 100 will rotate in the same direction as the shaft 35. The rotation direction of the shaft 35 is in turn controlled by the electronic control circuits for the copying machine, normally so as to move the scanner 6 from the starting position in the direction A through the desired length of travel corresponding to the length of the copy to be made, then to return it at a faster speed in the opposite direction.

FIGS. 3–6 show how the shaft 100 carries a pickup cam 101 having a cam lobe portion 101*a*. In reality this cam 101 is formed by a pair of polyoxymethylene disks 102 and 103 having respective identical lobes 102*a* and 103*a* serving as pickup deflector and each having a bent-out rear corner 102*b* and 103*b* and an inclined front edge 102*c* and 103*c*. Rivets 104 and 105 adjacent the shaft 100 rotationally link two cam disks 102 and 103 together and rotationally link them to the shaft 100.

The arm 28 is pivotable about a horizontal axle 107 and is biased upwardly into engagement with the periphery of the cam 101 formed by the disks 102 and 103 by means of a tension spring 106 connected between the free end of the arm 28 and a fixed part on the machine housing 1. It is also, of course, possible to simply weight or counterweight the arm 28 to bias it against the cam 101.

The upper surface of the arm 28 which bears against the cam 101 has at its outer end a pointer wedge 28*b* at the leading end of a slot 28*a* formed between a pair of ridges 28*c*. To each side of these ridges 28*c* is a part-cylindrical recess 28*d* whose center of curvature is the rotation axis of the shaft 100. The cam disks 102 and 103 each have cylindrical outer peripheries 102*d* and 103*d* spaced on the rotation axis of the shaft 100 and cylindrical outer peripheries 102*e* and 103*e* at the lobes 102*a* and 103*a* which are also centered on the axis of the shaft 100.

Figure 3:
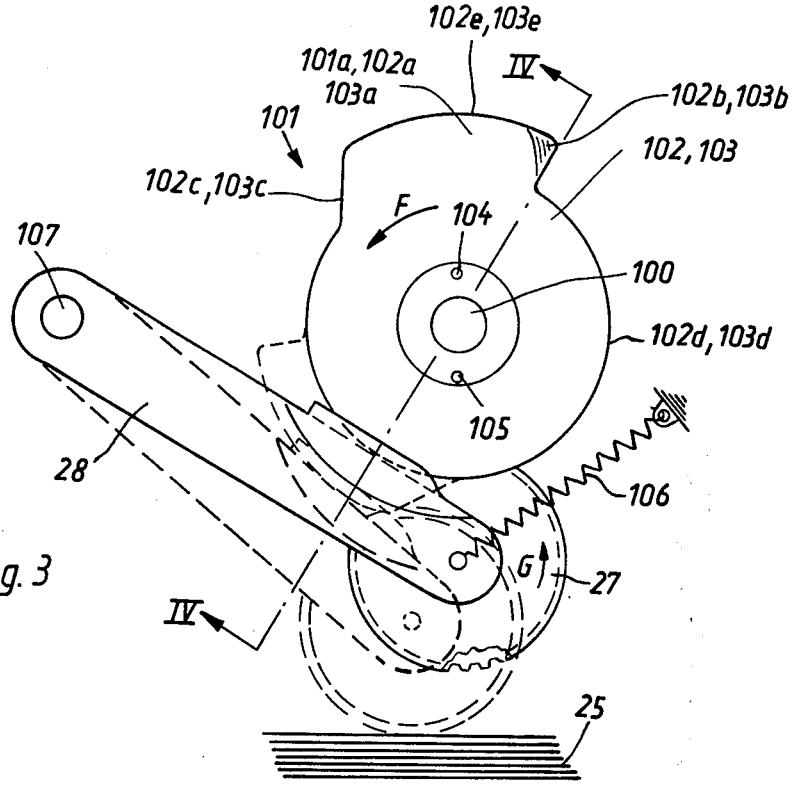
FIG. 3 is a large-scale side view of the pickup arm and associated mechanism according to this invention.
Figure 4:
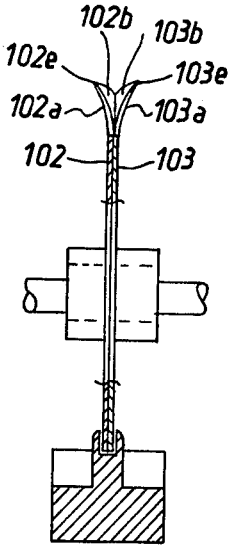
FIG. 4 is a section taken along line IV—IV of FIG. 3.
Figure 5:
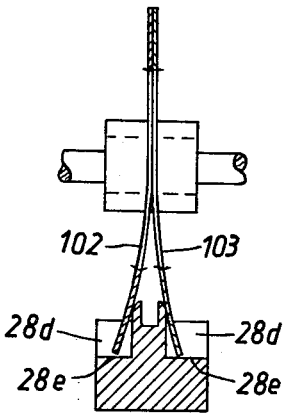
FIG. 5 is a view similar to FIG. 4 but illustrating the mechanism in another position.
Figure 6:
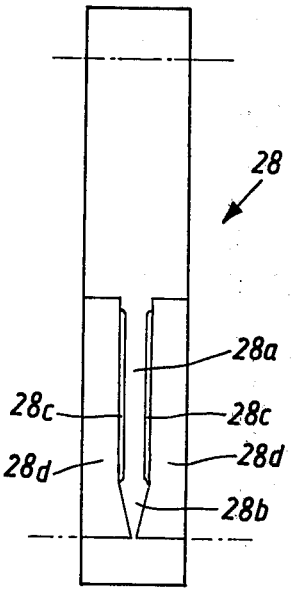
FIG. 6 is a top view of the pickup arm according to this invention.

When the cam 101 is rotated in the normal forward direction indicated by arrow F in FIG. 3 the two disks 102 and 103 will, to start with, lie in the position of FIG. 4 in the groove 28*a*. The disk rotates around in the direction F the backwardly inclined leading edges 102*c* and 103*c* of the lobes 101*a* and 102*a* will engage the base of the groove 28*a* and cam the arm 28 downwardly into the dashed-line position on FIG. 3. Once the outer peripheries or the outer track defined by the outer peripheries 102*e* and 103*e* is riding in the groove 28*a* the slightly toothed rollers 27, rotating in the direction indicated by arrow G, will contact the uppermost sheet in the stack 25 and slide it therefrom. As the disks 102 and 103 continue to rotate the bent-out trailing corners 102*b* and 103*b* will come into the groove 28*a* and will be held therein, being deformed slightly inwardly. Finally the rear ends 102*b* and 103*b* will pass in the direction F past the arm 28 and allow it to be pulled back upwardly by the spring 106 onto the peripheries 102*d* and 103*d*.

Subsequent reverse rotation opposite the direction F of the cams 102 and 103 will bring the bent-out ends 102*b* and 103*b* into engagement on either side of the pointer wedge 28*b*. This will spread these two disks 102 and 103 elastically apart and cause the outer peripheries 102*e* and 103*e* to ride along the base of the recesses 28*e*, without downward deflection of the arm 28.

Thus when rotating in the forward direction indicated by F the arm 28 will be cammed downwardly by the lobes 102*a* and 103*a*, but when rotating in the reverse direction no such downward camming will occur. The angular length of the peripheries 102*e* and 103*e* is calculated to displace the uppermost sheet just enough to wedge it in the nip between the rollers 29 and 30.

Figure 7:
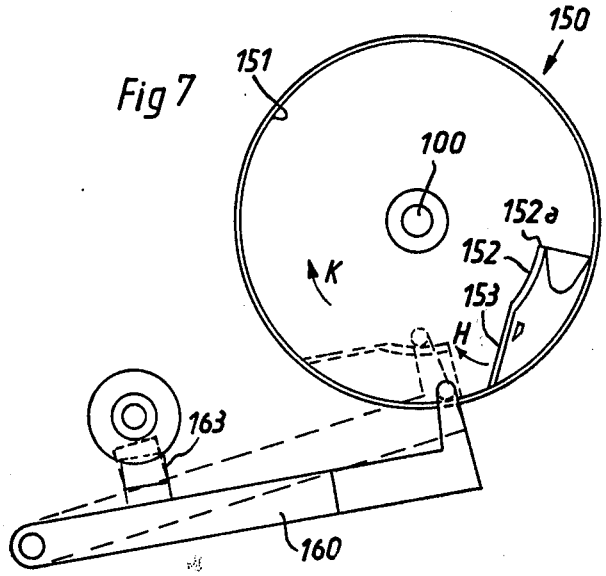
FIG. 7 is a side view of the pinch cam assembly according to this invention.
Figure 8:
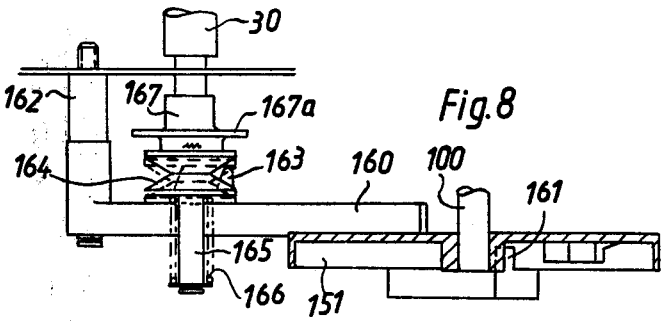
FIG. 8 is a horizontal section through the assembly of FIG. 7.

In their turn as shown in FIGS. 7 and 8 the rollers 29 and 30, which are geared together at their not illustrated far ends are operated by a pinch cam 150 carried also on the shaft 100. This cam 150 has a cylindrically extending rim or periphery 151 defining an outer track and has an inner projection 152 defining an inner track having a rear end 152*e* and connected via a deflector 153 displaceable against spring force inwardly in direction H with the outer track 151.

A pinch cam follower 160 pivotal about an axis 162 on the machine housing parallel to the axis of rotation of the roller 30 has a follower end or arm 161 that rides inside the cam 150 and can ride on either of the tracks 151 and 152. This cam-follower arm 160 carries a wedge 163 that constitutes a pinch deflector and can act against a spring 166 on a jaw 164 of a clutch carried on the shaft 165 of the roller 30. The other jaw of the clutch 167 has a periphery 167*a* that is continuously driven so that when the wedge 163 is moved up the two jaws 164 and 167 mesh and the roller 30 is coupled to the continuously driven element 167.

So long as the follower 161 rides on the outer track 151 the wedge 163 is out of contact with the jaw 164 and the roller 30 does not rotate. When, however, the follower 161 moves up the deflector 153 onto the inner track 152 the roller 30 is positively driven. Rotation of the 150 in the forward direction K will therefore cause the cam follower 161 to slide along the track 151, then slide up the deflector 153 onto the inner track 152. This will couple the rollers 29 and 30 to the drive element 167*a*. As soon as the follower 161 comes to the rear end 152*a* of the track 152 it will drop by gravitational force back down onto the outer track 151 and stop the rollers 29 and 30.

Reverse rotation of the cam 150 in a direction against the direction K when the follower 161 has dropped back onto the track 151 will cause this follower 161 to move along underneath the outer track 152. When it engages the back of the deflector 153 it will spring it resiliently up in the direction H so it can move out from underneath it to a position ahead of it on the track 151. This action will, of course, take place without radial deflection of the follower 161 so that during such reverse rotation of the cam 150 the rollers 29 and 30 will not be driven. The length of the inner track 152 is calculated to be sufficient to advance the longest possible copy sheet through the nip between the rollers 29 and 30.

Thus with the machine according to the present invention the pickup mechanism and sheet advance mechanism is automatically and mechanically controlled in accordance with the drive for the scanner. Once the synchronization has been properly established it is virtually impossible for it to maladjust itself so that thereafter exact and correct operation of the machine is ensured. What is more these relatively simple cam mechanisms that effect this synchronized operation require virtually no servicing and have an extremely long service life. Thus the complex problems caused by use of limit switches, solenoids, and the like are totally avoided.

It will be understood that each of the elements described above, or two or more together, may also find a useful application in other types of machines differing from the types described above.

While the invention has been illustrated and described as embodied in a copying apparatus, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A copying apparatus comprising:

a housing;

a paper tray on said housing adapted to hold a stack of copy sheets;

a rotatable pickup roller pivotal into and out of engagement with the uppermost sheet of said stack;

a pickup cam follower linked to said pickup roller;

a pickup cam engageable with said pickup follower and having a pickup cam portion;

means for rotating said pickup cam in a forward rotational direction and in an opposite reverse rotational direction; and means including a pickup deflector for travel of said pickup follower along said pickup cam portion during forward rotation of said pickup cam with concomitant pivoting of said pickup roller into engagement with said uppermost sheet and for travel of said pickup follower during reverse rotation adjacent said pickup cam portion without concomitant pivoting of said pickup roller into engagement with said uppermost sheet.

2. The copying apparatus defined in claim 1, further comprising:

a pair of pinch rollers adjacent said paper tray;

means including a deflectable cam follower displacement from a normal portion position for rotating said pinch rollers;

a pinch cam engageable with said pinch cam follower and having a pinch cam portion;

means for rotating said pinch cam in a forward rotational direction and in an opposite reverse rotational direction;

means including a pinch deflector for travel of said pinch follower along said pinch cam portion during forward rotation of said pinch cam with concomitant rotation of said pinch rollers and for travel of said pinch follower on reverse rotation of said pinch cam adjacent said pinch cam portion without rotation of said pinch rollers.

3. The apparatus defined in claim 2 wherein said means for rotating includes at least one cam shaft carrying at least one of said cams.

4. The apparatus defined in claim 3, further comprising a drive shaft;

a master-scanning device connected to said drive shaft and displaceable in two directions;

drive means connected to said drive shaft for rotating same in one direction and thereby displacing said scanning device in one direction and for rotating said drive shaft in another opposite direction and thereby displacing said scanning device in the opposite direction; and transmission means positively linking said drive shaft to said cam shaft for joint rotation and constituting said means for rotating said pickup cam and said pinch cam.

5. The apparatus defined in claim 4 wherein both of said cams are mounted on said cam shaft.

6. The apparatus defined in claim 5 wherein said pinch cam has a track and said pinch cam portion is spaced therefrom, said pinch deflector extending between said pinch cam portion and said track and lying in said forward direction of rotation generally ahead of said pinch cam portion, said pinch cam portion being spaced from said track.

7. The apparatus defined in claim 6 wherein said pinch cam is cup-shaped and has a rim constituting said track, said pinch cam portion being inside and generally parallel to said track, said pinch follower engaging inside said pinch cam.

8. The apparatus defined in claim 4 wherein said pickup cam is a semirigid and elastically flexible disk, said pickup deflector being engageable with said disk to deform the same and displace said pickup cam portion into a position adjacent and unengageable with said pickup cam follower.

9. The apparatus defined in claim 8 wherein said pickup cam has two such disks and said deflector is a projection formed on said pickup follower and engageable between said disks.

10. The apparatus defined in claim 9 wherein the pickup cam portions of said disks each have relative to said forward direction of rotation a rear end portion bent out away from the corresponding rear end portion of the other disk, said pickup deflector being on said pickup follower and having a point engageable between said rear end portions.

11. The apparatus defined in claim 10 wherein said pickup cam follower is formed with a central pickup cam engaging region engageable with said pickup cam portion on forward rotation of said pickup cam and to each side of said region with a pair of deeper pickup cam engaging recesses having centers of curvature centered on said cam shaft.

12. The apparatus defined in claim 4, further comprising means for continuously rotating said pickup roller.

13. The apparatus defined in claim 4 wherein said means for rotating said pinch cam includes a clutch connected on one side of said cam and on the other side to said drive shaft, said pinch cam follower being connected to said clutch for engaging and disengaging same.

14. The apparatus defined in claim 13 wherein said clutch has a pair of jaws axially engageable to couple said sides together, said pinch cam follower being connected to one of said jaws for axially displacing same toward and away from the other of said jaws.

* * * * *